US008239209B2

(12) United States Patent
Oh et al.

(10) Patent No.: US 8,239,209 B2
(45) Date of Patent: Aug. 7, 2012

(54) METHOD AND APPARATUS FOR DECODING AN AUDIO SIGNAL USING A RENDERING PARAMETER

(75) Inventors: Hyen-O Oh, Gyeonggi-do (KR); Hee Suk Pang, Seoul (KR); Dong Soo Kim, Seoul (KR); Jae Hyun Lim, Seoul (KR); Yang-Won Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 795 days.

(21) Appl. No.: 12/161,331

(22) PCT Filed: Jan. 19, 2007

(86) PCT No.: PCT/KR2007/000347

§ 371 (c)(1),
(2), (4) Date: Jul. 17, 2008

(87) PCT Pub. No.: WO2007/083957

PCT Pub. Date: Jul. 26, 2007

(65) Prior Publication Data

US 2008/0319765 A1 Dec. 25, 2008

Related U.S. Application Data

(60) Provisional application No. 60/759,980, filed on Jan. 19, 2006, provisional application No. 60/772,555, filed on Feb. 13, 2006, provisional application No. 60/787,172, filed on Mar. 30, 2006, provisional application No. 60/791,432, filed on Apr. 13, 2006, provisional application No. 60/865,256, filed on Nov. 10, 2006.

(30) Foreign Application Priority Data

Oct. 2, 2006 (KR) ..... 10-2006-0097319

(51) Int. Cl.

| | |
|---|---|
| ***G10L 19/00*** | (2006.01) |
| ***G10L 19/04*** | (2006.01) |
| ***G10L 21/00*** | (2006.01) |
| *G10L 19/02* | (2006.01) |

(52) U.S. Cl. ..... 704/503; 704/201; 704/205; 704/229; 704/504

(58) Field of Classification Search ..... None
See application file for complete search history.

(56) References Cited

U.S. PATENT DOCUMENTS 5,166,685 A 11/1992 Campbell et al.

(Continued)

FOREIGN PATENT DOCUMENTS

EP 1455345 9/2004

(Continued)

OTHER PUBLICATIONS

Russian Notice of Allowance for Application No. 2008114388, dated Aug. 24, 2009, 13 pages.

(Continued)

*Primary Examiner* — Justin Rider
(74) *Attorney, Agent, or Firm* — Fish & Richardson P.C.

(57) ABSTRACT

An apparatus for decoding a signal and method thereof are disclosed, by which the audio signal can be controlled in a manner of changing/giving spatial characteristics (e.g., listener's virtual position, virtual position of a specific source) of the audio signal. The present invention includes receiving an object parameter including level information corresponding to at least one object signal, converting the level information corresponding to the object signal to the level information corresponding to an output channel by applying a control parameter to the object parameter, and generating a rendering parameter including the level information corresponding to the output channel to control an object downmix signal resulting from downmixing the object signal.

7 Claims, 9 Drawing Sheets

U.S. PATENT DOCUMENTS

| | | | |
|---|---|---|---|
| 5,524,054 | A | 6/1996 | Spille et al. |
| 5,572,615 | A | 11/1996 | Emori |
| 5,579,396 | A | 11/1996 | Iida et al. |
| 5,632,005 | A | 5/1997 | Davis et al. |
| 5,703,584 | A | 12/1997 | Hill et al. |
| 5,714,997 | A | 2/1998 | Anderson |
| 6,118,875 | A | 9/2000 | Møller et al. |
| 6,307,941 | B1 | 10/2001 | Tanner et al. |
| 6,574,339 | B1 | 6/2003 | Kim |
| 6,711,266 | B1 | 3/2004 | Aylward |
| 6,973,130 | B1 | 12/2005 | Wee et al. |
| 7,519,538 | B2 | 4/2009 | Villemoes et al. |
| 7,555,434 | B2 | 6/2009 | Nomura et al. |
| 7,916,873 | B2 | 3/2011 | Villemoes et al. |
| 2003/0236583 | A1 | 12/2003 | Baumgarte et al. |
| 2004/0071445 | A1 | 4/2004 | Tarnoff et al. |
| 2004/0196770 | A1 | 10/2004 | Touyama et al. |
| 2005/0074127 | A1 | 4/2005 | Herre et al. |
| 2005/0180579 | A1 | 8/2005 | Baumgarte et al. |
| 2005/0195981 | A1 | 9/2005 | Faller et al. |
| 2005/0223276 | A1 | 10/2005 | Moller et al. |
| 2005/0271288 | A1 | 12/2005 | Suzuki et al. |
| 2005/0271367 | A1 | 12/2005 | Lee et al. |
| 2006/0115100 | A1 | 6/2006 | Faller et al. |
| 2006/0133618 | A1 | 6/2006 | Villemoes et al. |
| 2006/0153408 | A1 | 7/2006 | Faller et al. |

FOREIGN PATENT DOCUMENTS

| | | |
|---|---|---|
| JP | 09-275544 | 10/1997 |
| JP | 2001-188578 | 7/2001 |
| JP | 2006-050241 | 2/2006 |
| JP | 2007-539174 | 5/2006 |
| JP | 08-065169 | 3/2008 |
| JP | 08-202397 | 9/2008 |
| KR | 10-2001-0001993 | 1/2001 |
| KR | 10-2001-0009258 | 2/2001 |
| RU | 2119259 | 9/1998 |
| RU | 2129336 | 4/1999 |
| TW | 289885 | 11/1996 |
| TW | 550541 | 9/2003 |
| TW | 200304120 | 9/2003 |
| TW | 200405673 | 4/2004 |
| TW | 594675 | 6/2004 |
| TW | I233606 | 6/2005 |
| TW | I246861 | 1/2006 |
| WO | 9949574 | 9/1999 |
| WO | WO 03/007656 | 1/2003 |
| WO | 03-090208 | 10/2003 |
| WO | 2004-008805 | 1/2004 |
| WO | 2004-019656 | 3/2004 |
| WO | 2004-036549 | 4/2004 |
| WO | 2004-036954 | 4/2004 |
| WO | 2004-036955 | 4/2004 |
| WO | 2004036548 | 4/2004 |

OTHER PUBLICATIONS

Taiwan Examiner, Taiwanese Office Action for Application No. 96104544, dated Oct. 9, 2009, 13 pages.

Beack et al., "CE on Multichannel Sound Scene Control for MPEG Surround," ITU Study Group 16—Video Coding Experts Group—ISO/IEC MPEG & ITU-T VCEG (ISO/IEC JTC1/SC29/WG11 and ITU-T SG16 Q6), XX, XX, No. M13160, Mar. 29, 2006, 9 pages.

Breebaart et al., "MPEG Surround Binaural Coding Proposal Philips/CT/ThG/VAST Audio," ITU Study Group 16—Video Coding Experts Group—ISO/IEC MPEG & ITU-T VCEG (ISO/IEC JTC1/SC29/WG11 and ITU-T SG16 Q6), XX, XX, No. M13253, Mar. 29, 2006, 49 pages.

"Concepts of Object-Oriented Spatial Audio Coding," ITU Study Group 16—Video Coding Experts Group—ISO/IEC MPEG & ITU-T VCEG (ISO/IEC JTC1/SC29/WG11 and ITU-T SG16 Q6), XX, XX, No. N8329, Jul. 21, 2006, 8 pages.

Search Report, European Appln. No. 07701034.6, dated Apr. 4, 2011, 7 pages.

Search Report, European Appln. No. 07701035.3, dated May 10, 2011, 8 pages.

Hotho et al., "MPEG Surround CE on Improved Performance Artistic Downmix," ITU Study Group 16—Video Coding Experts Group—ISO/IEC MPEG & ITU-T VCEG (ISO/IEC JTC1/SC29/WG11 and ITU-T SG16 Q6), No. M12899, Jan. 11, 2006, 18 pages.

Jung et al., "New CLD Quantization Method for Spatial Audio Coding," Audio Engineering Society: Convention Paper 6734, AES 120$^{th}$ Convention, May 20-23, 2006, 3 pages.

Kjörling et al., "Information on MPEG Surround CE on Scalable Channel Decoding," ITU Study Group 16 Video Coding Experts Group—ISO/IEC MPEG & ITU-T VCEG (ISO/IEC JTC1/SC29/WG11 and ITU-T SG16 Q6), XX, XX, No. M13261, Mar. 30, 2006, 13 pages.

Ojala and Jakka, "Further Information on Nokia Binaural Decoder," ITU Study Group 16—Video Coding Experts Group—ISO/IEC MPEG & ITU-T VCEG (ISO/IEC JTC1/SC29/WG11 and ITU-T SG16 Q6), XX, XX, No. M13231, Mar. 29, 2006, 8 pages.

Jakka et al., "New Use Cases for Spatial Audio Coding," ITU Study Group 16—Video Coding Expeerts Group—ISO/IEC MPEG & ITU-T VCEG (ISO/IEC JTC1/SC29/WG11 and ITU-T SG16 Q6), XX, XX, No. M12913, Jan. 11, 2006, 11 pages.

Notice of Allowance, Taiwanese Application No. 096102409, dated May 27, 2010, 8 pages (with English translation).

Office Action, Taiwanese Application No. 096102408, mailed May 17, 2010, 7 pages.

Taiwan Patent Office, Office Action in Taiwanese patent application 096102410, dated Jul. 2, 2009, 5 pages.

Breebaart, et al.: "Multi-Channel Goes Mobile: MPEG Surround Binaural Rendering" In: Audio Engineering Society the 29th International Conference, Seoul, Sep. 2-4, 2006, pp. 1-13. See the abstract, pp. 1-4, figures 5,6.

Breebaart, J., et al.: "MPEG Spatial Audio Coding/MPEG Surround: Overview and Current Status" In: Audio Engineering Society the 119th Convention, New York, Oct. 7-10, 2005, pp. 1-17. See pp. 4-6.

Faller, C., et al.: "Binaural Cue Coding-Part II: Schemes and Applications", IEEE Transactions on Speech and Audio Processing, vol. 11, No. 6, 2003, 12 pages.

Faller, C.: "Coding of Spatial Audio Compatible with Different Playback Formats", Audio Engineering Society Convention Paper, Presented at 117th Convention, Oct. 28-31, 2004, San Francisco, CA.

Faller, C.: "Parametric Coding of Spatial Audio", Proc. of the 7th Int. Conference on Digital Audio Effects, Naples, Italy, 2004, 6 pages.

Herre, J., et al.: "Spatial Audio Coding: Next generation efficient and compatible coding of multi-channel audio", Audio Engineering Society Convention Paper, San Francisco, CA , 2004, 13 pages.

Herre, J., et al.: "The Reference Model Architecture for MPEG Spatial Audio Coding", Audio Engineering Society Convention Paper 6447, 2005, Barcelona, Spain, 13 pages.

International Search Report in International Application No. PCT/KR2006/000345, dated Apr. 19, 2007, 1 page.

International Search Report in International Application No. PCT/KR2006/000346, dated Apr. 18, 2007, 1 page.

International Search Report in International Application No. PCT/KR2006/000347, dated Apr. 17, 2007, 1 page.

International Search Report in International Application No. PCT/KR2006/000866, dated Apr. 30, 2007, 1 page.

International Search Report in International Application No. PCT/KR2006/000867, dated Apr. 30, 2007, 1 page.

International Search Report in International Application No. PCT/KR2006/000868, dated Apr. 30, 2007, 1 page.

International Search Report in International Application No. PCT/KR2006/001987, dated Nov. 24, 2006, 2 pages.

International Search Report in International Application No. PCT/KR2006/002016, dated Oct. 16, 2006, 2 pages.

International Search Report in International Application No. PCT/KR2006/003659, dated Jan. 9, 2007, 1 page.

International Search Report in International Application No. PCT/KR2006/003661, dated Jan. 11, 2007, 1 page.

International Search Report in International Application No. PCT/KR2007/000340, dated May 4, 2007, 1 page.

International Search Report in International Application No. PCT/KR2007/000668, dated Jun. 11, 2007, 2 pages.

International Search Report in International Application No. PCT/KR2007/000672, dated Jun. 11, 2007, 1 page.

International Search Report in International Application No. PCT/KR2007/000675, dated Jun. 8, 2007, 1 page.
International Search Report in International Application No. PCT/KR2007/000676, dated Jun. 8, 2007, 1 page.
International Search Report in International Application No. PCT/KR2007/000730, dated Jun. 12, 2007, 1 page.
International Search Report in International Application No. PCT/KR2007/001560, dated Jul. 20, 2007, 1 page.
International Search Report in International Application No. PCT/KR2007/001602, dated Jul. 23, 2007, 1 page.
Scheirer, E. D., et al.: "AudioBIFS: Describing Audio Scenes with the MPEG-4 Multimedia Standard", IEEE Transactions on Multimedia, Sep. 1999, vol. 1, No. 3, pp. 237-250. See the abstract.
Vannanen, R., et al.: "Encoding and Rendering of Perceptual Sound Scenes in the Carrouso Project", AES 22nd International Conference on Virtual, Synthetic and Entertainment Audio, Paris, France, 9 pages, Jun. 2002.
Vannanen, Riitta, "User Interaction and Authoring of 3D Sound Scenes in the Carrouso EU project", Audio Engineering Society Convention Paper 5764, Amsterdam, The Netherlands, 2003, 9 pages.
Faller and Baumgarte, "Efficient Representation of Spatial Audio Using Perceptual Parametrization," Proceedings of the 2001 IEEE Workshop on the Applications of Signal Processing to Audio and Acoustics, Oct. 21, 2001, pp. 199-202.
Schuijers et al., "Advances in Parametric Coding for High-Quality Audio", Convention Paper 5852, 114th AES Convention, Amsterdam, The Netherlands, Mar. 22-25, 2003, 11 pages.
Office Action, U.S. Appl. No. 12/161,562, dated Oct. 13, 2011, 9 pages.

[Fig. 1]
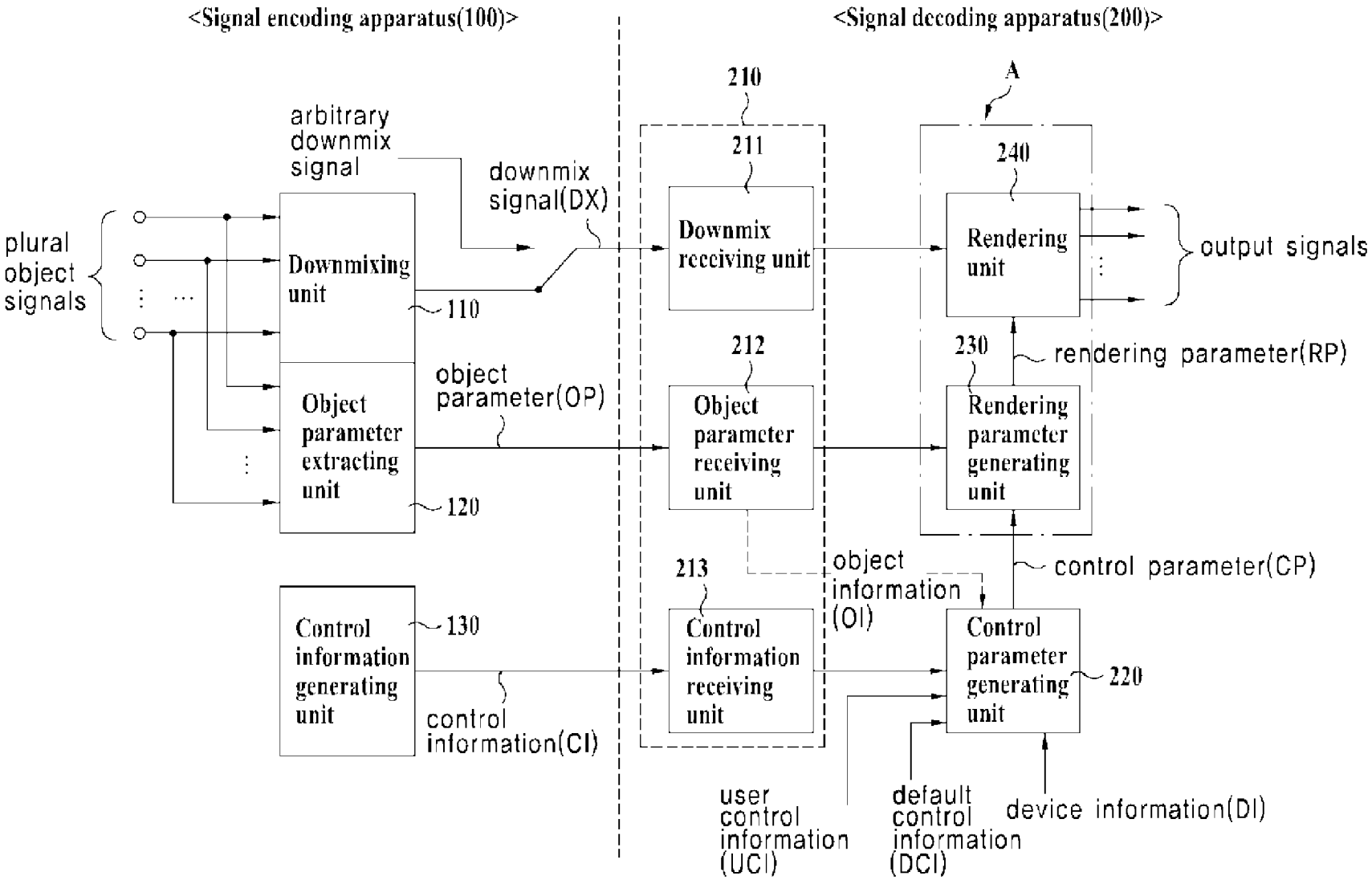

[Fig. 2]
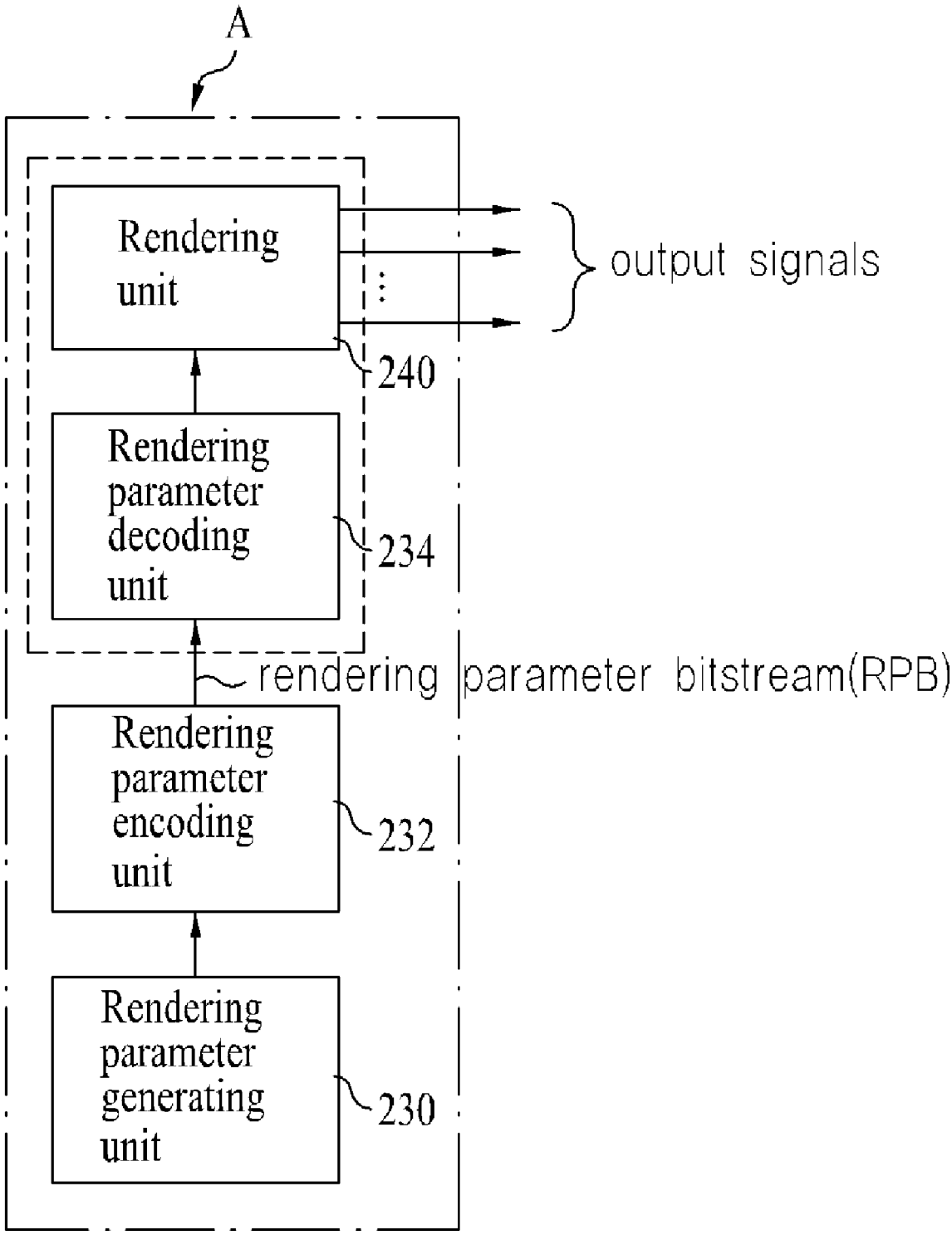

[Fig. 3]
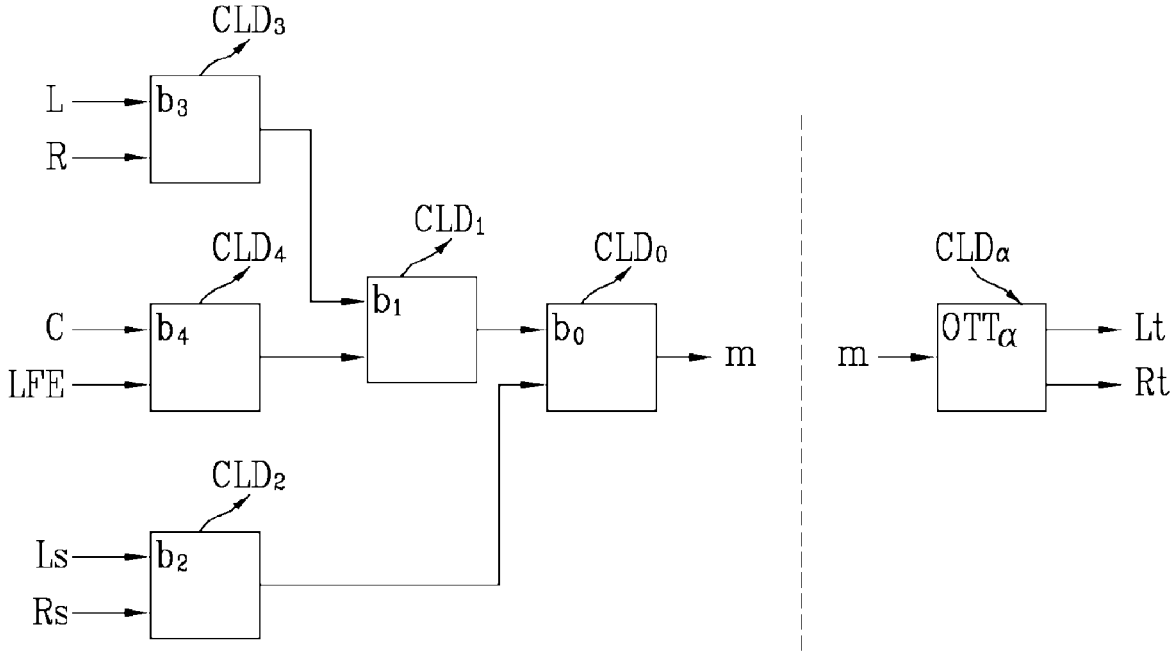

[Fig. 4]
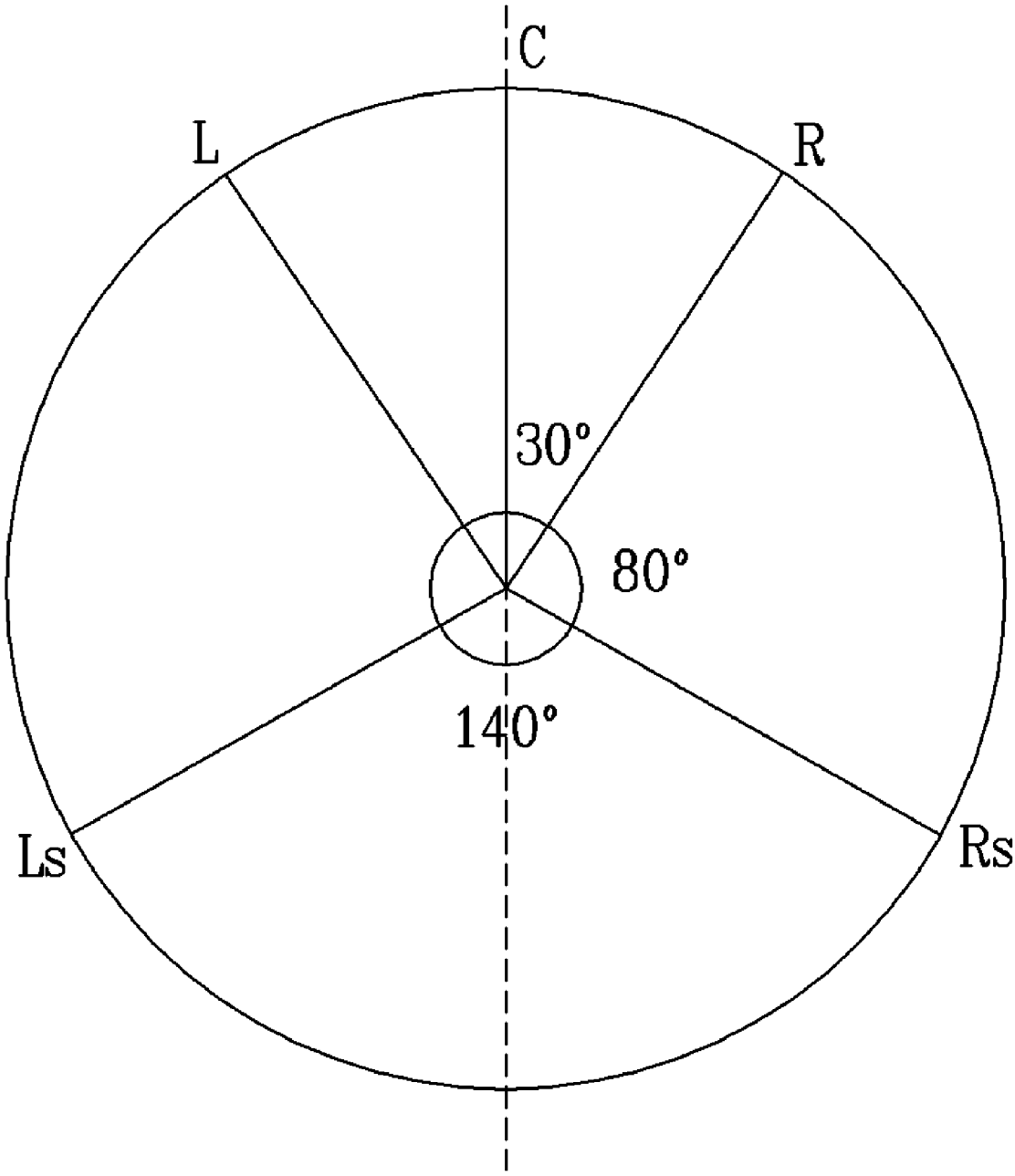

[Fig. 5]
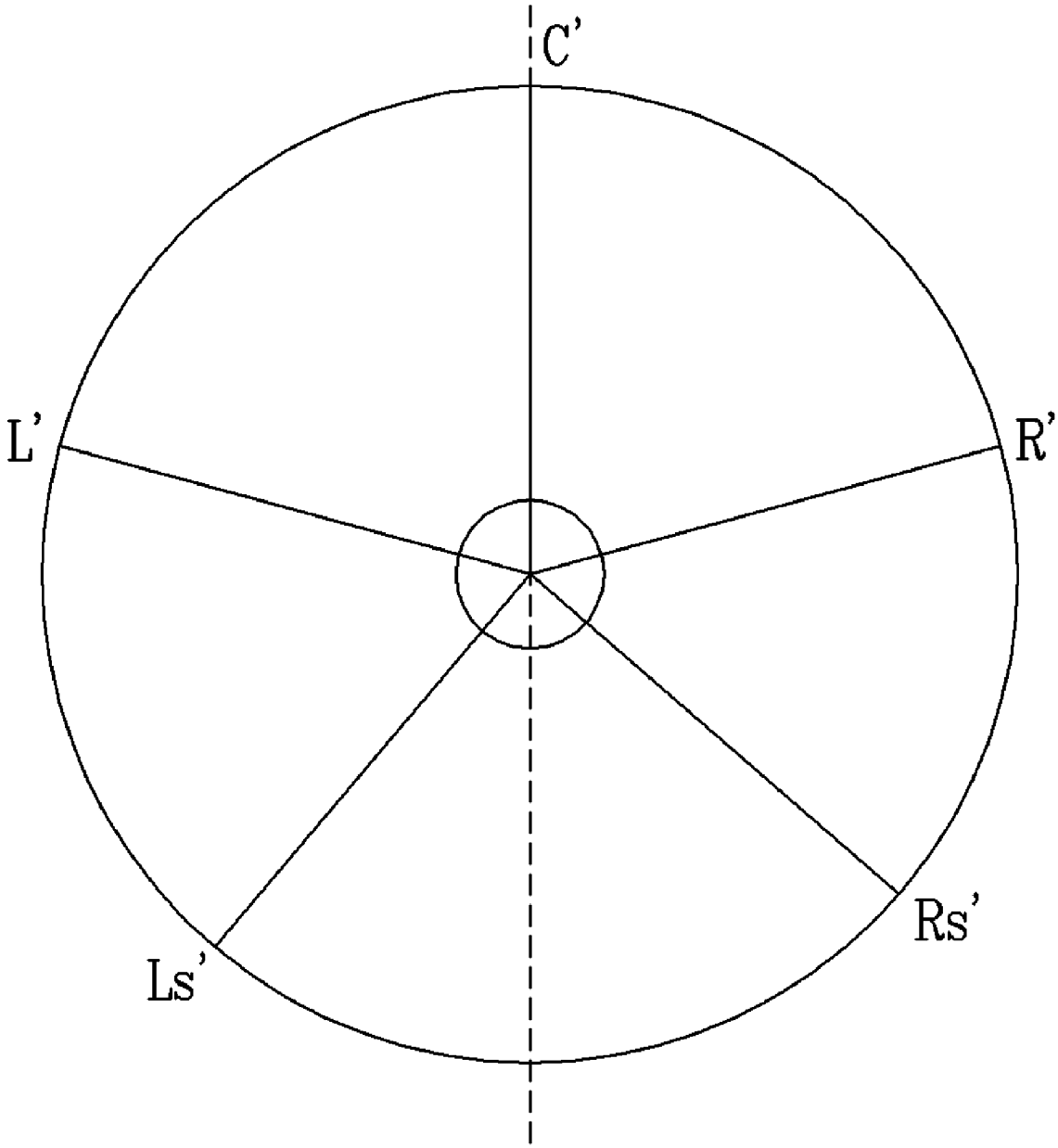

[Fig. 6]
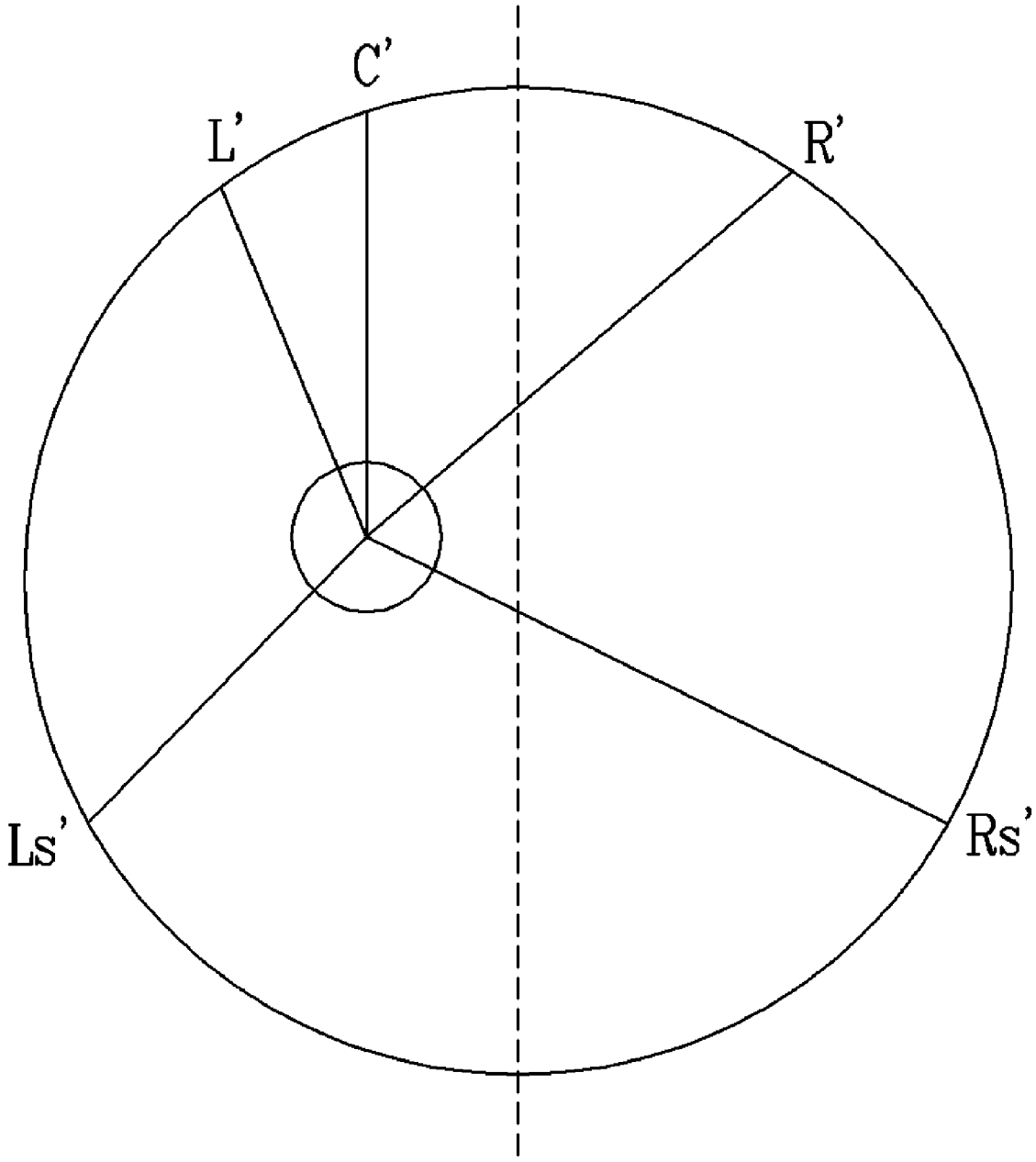

[Fig. 7]
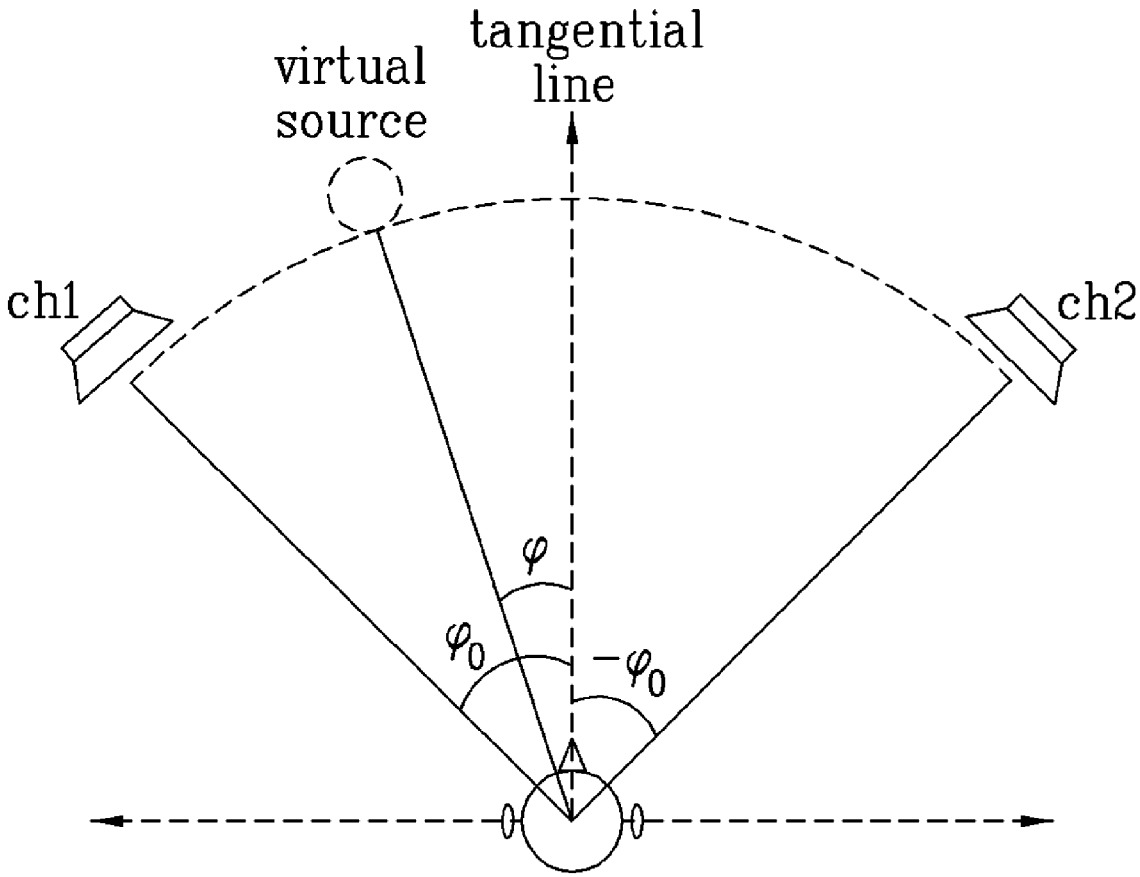

[Fig. 8]
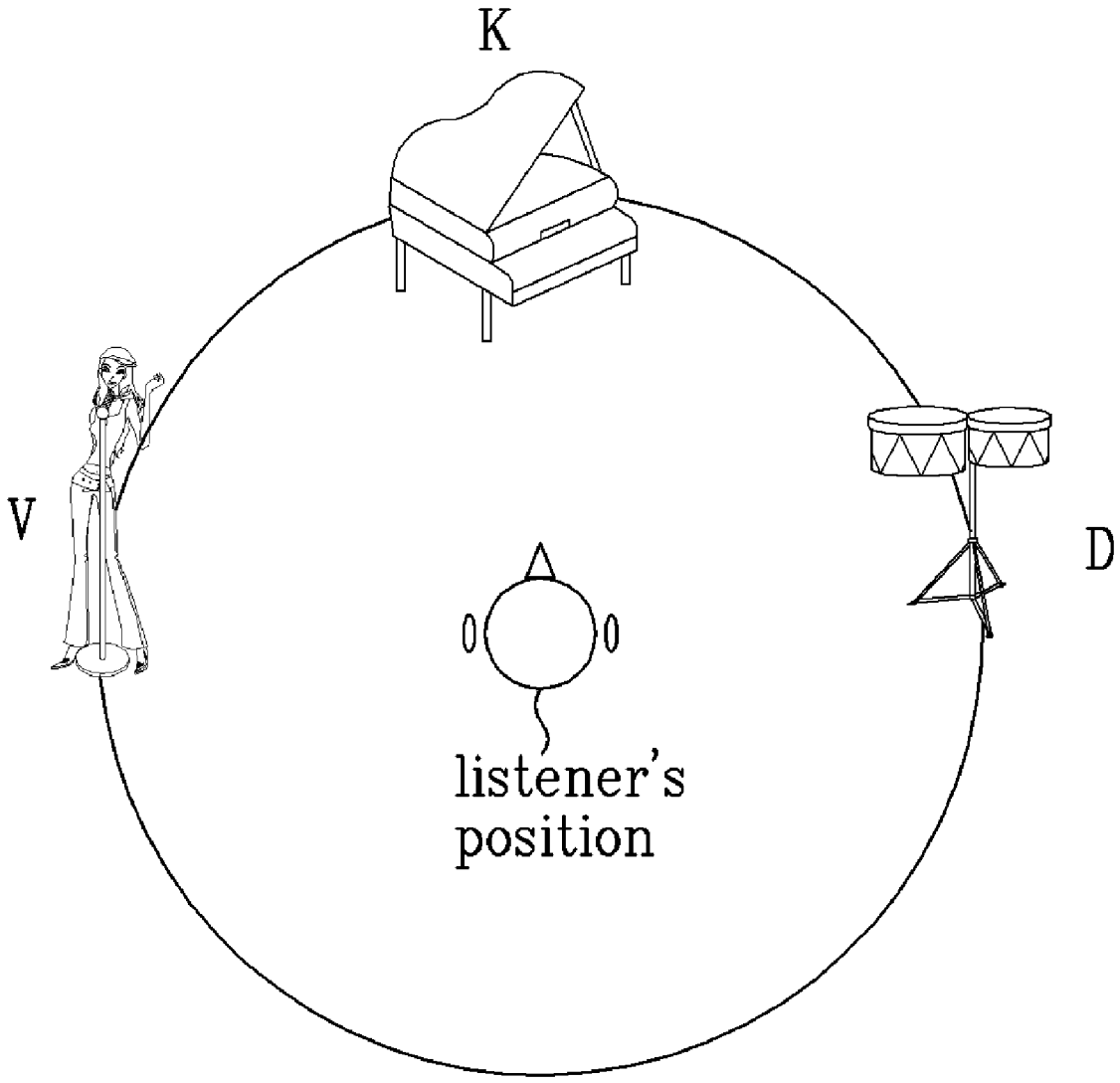

[Fig. 9]
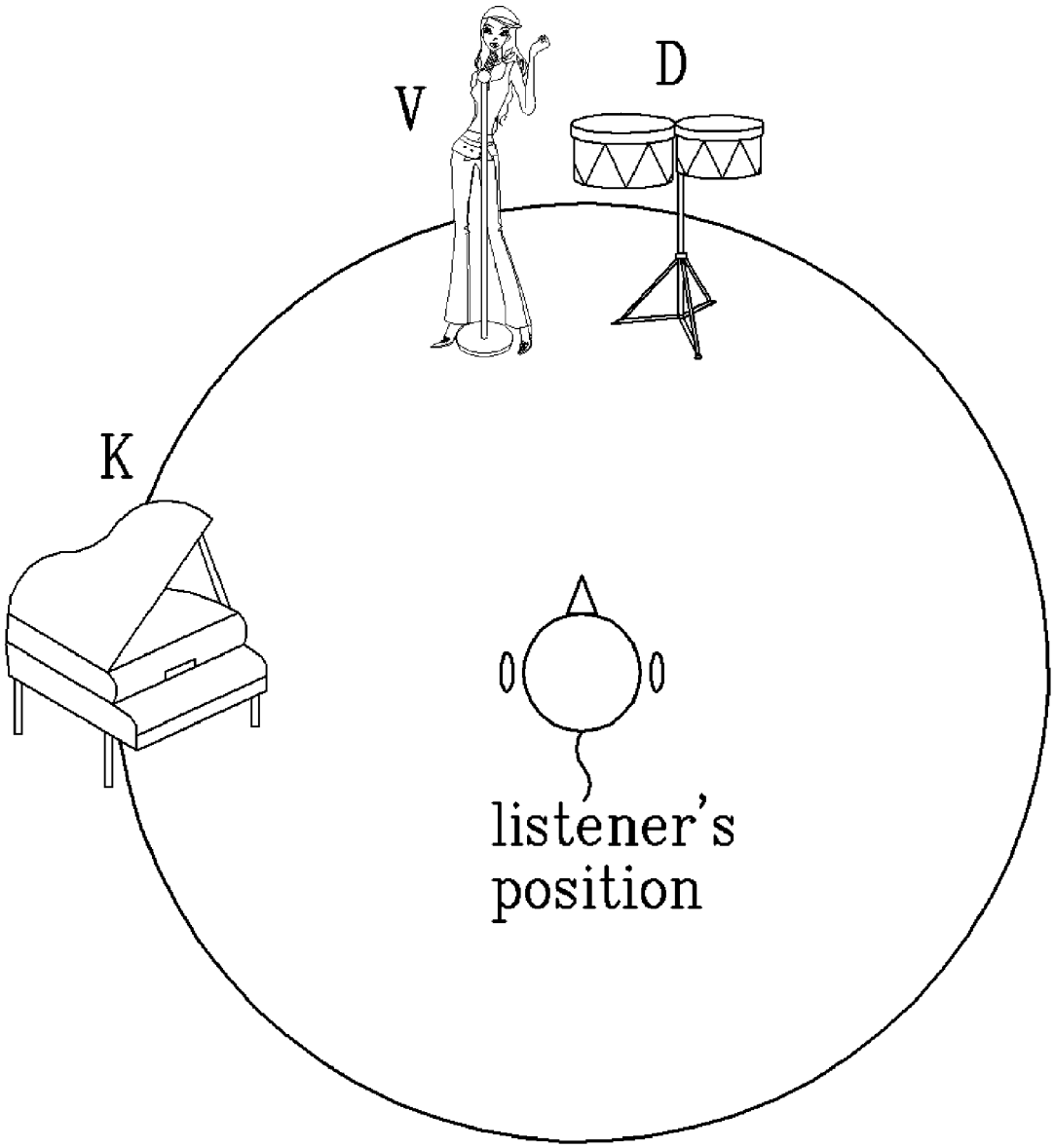

METHOD AND APPARATUS FOR DECODING AN AUDIO SIGNAL USING A RENDERING PARAMETER

TECHNICAL FIELD

The present invention relates to a method and an apparatus for decoding a signal, and more particularly, to a method and an apparatus for decoding an audio signal. Although the present invention is suitable for a wide scope of applications, it is particularly suitable for decoding audio signals.

BACKGROUND ART

Generally, an audio signal is decoded by generating an output signal (e.g., multi-channel audio signal) from rendering a downmix signal using a rendering parameter (e.g., channel level information) generated by an encoder.

DISCLOSURE OF INVENTION

Technical Problem

However, in case of using the rendering parameter generated by the encoder for rendering as it is, a decoder is unable to generate an output signal according to device information (e.g., number of available output channels), change a spatial characteristic of an audio signal, and give a spatial characteristic to the audio signal. In particular, it is unable to generate audio signals for a channel number meeting the number of available output channels of the decoder, shift a virtual position of a listener to a stage or a last row of seats, or give a virtual position (e.g., left side) of a specific source signal (e.g., piano signal).

Technical Solution

Accordingly, the present invention is directed to an apparatus for decoding a signal and method thereof that substantially obviate one or more of the problems due to limitations and disadvantages of the related art.

An object of the present invention is to provide an apparatus for decoding a signal and method thereof, by which the audio signal can be controlled in a manner of changing/giving spatial characteristics (e.g., listener's virtual position, virtual position of a specific source) of the audio signal.

Another object of the present invention is to provide an apparatus for decoding a signal and method thereof, by which an output signal matching information for an output available channel of a decoder can be generated.

Advantageous Effects

Accordingly, the present invention provides the following effects or advantages.

First of all, since control information and/or device information is considered in converting an object parameter, it is able to change a listener's virtual position or a virtual position of a source in various ways and generate output signals matching a number of channels available for outputs.

Secondly, a spatial characteristic is not given to an output signal or modified after the output signal has been generated. Instead, after an object parameter has been converted, an output signal is generated using the converted object parameter (rendering parameter). Hence, it is able to considerably reduce a quantity of calculation.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 is a block diagram of an apparatus for encoding a signal and an apparatus for decoding a signal according to one embodiment of the present invention;

FIG. 2 is a block diagram of an apparatus for decoding a signal according to another embodiment of the present invention;

FIG. 3 is a block diagram to explain a relation between a channel level difference and a converted channel difference in case of 5-1-5 tree configuration;

FIG. 4 is a diagram of a speaker arrangement according to ITU recommendations;

FIG. 5 and FIG. 6 are diagrams for virtual speaker positions according to 3-dimensional effects, respectively;

FIG. 7 is a diagram to explain a position of a virtual sound source between speakers; and, FIG. 8 and FIG. 9 are diagrams to explain a virtual position of a source signal, respectively.

BEST MODE FOR CARRYING OUT THE INVENTION

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a method of decoding a signal according to the present invention includes the steps of receiving an object parameter including level information corresponding to at least one object signal, converting the level information corresponding to the at least one object signal to the level information corresponding to an output channel by applying a control parameter to the object parameter, and generating a rendering parameter including the level information corresponding to the output channel to control an object downmix signal resulting from downmixing the at least one object signal.

Preferably, the at least one object signal includes a channel signal or a source signal.

Preferably, the at least one object signal includes at least one of object level information and inter-object correlation information.

More preferably, if the at least one object signal is a channel signal, the object level information includes a channel level difference.

And, if the at least one object signal is a source signal, the object level information includes a source level difference.

Preferably, the control parameter is generated using control information.

More preferably, the control information includes at least one of control information received from an encoder, user control information, default control information, device control information, and device information.

And, the control information includes at least one of HRTF filter information, object position information, and object level information.

Moreover, if the at least one object signal is a channel signal, the control information includes at least one of virtual position information of a listener and virtual position information of a multi-channel speaker.

Besides, if the at least one object signal is a source signal, the control information includes at least one level information of the source signal and virtual position information of the source signal.

Preferably, the control parameter is generated using object information based on the object parameter.

Preferably, the method further includes the steps of receiving the object downmix signal based on the at least one object signal and generating an output signal by applying the rendering parameter to the object downmix signal.

To further achieve these and other advantages and in accordance with the purpose of the present invention, an apparatus for decoding a signal includes an object parameter receiving unit receiving an object parameter including level information corresponding to at least one object signal and a rendering parameter generating unit converting the level information corresponding to the at least one object signal to the level information corresponding to an output channel by applying a control parameter to the object parameter, the rendering parameter generating unit generating a rendering parameter including the level information corresponding to the output channel to control an object downmix signal resulting from downmixing the at least one object signal.

Preferably, the apparatus further includes a rendering unit generating an output signal by applying the rendering parameter to the object downmix signal based on the at least one object signal.

Preferably, the apparatus further includes a rendering parameter encoding unit generating a rendering parameter stream by encoding the rendering parameter.

It is to be understood that both the foregoing general description and the following detailed description are exemplary and explanatory and are intended to provide further explanation of the invention as claimed.

MODE FOR THE INVENTION

Reference will now be made in detail to the preferred embodiments of the present invention, examples of which are illustrated in the accompanying drawings.

First of all, in order to control an object downmix signal by changing a spatial characteristic of the object downmix signal, giving a spatial characteristic to the object downmix signal, or modifying an audio signal according to device information for a decoder, a rendering parameter is generated by converting an object parameter. In this case, the object downmix signal (hereinafter called downmix signal is generated from downmixing plural object signals (channel signals or source signals). So, it is able to generate an output signal by applying the rendering parameter to the downmix signal.

FIG. 1 is a block diagram of an apparatus for encoding a signal and an apparatus for decoding a signal according to one embodiment of the present invention.

Referring to FIG. 1, an apparatus 100 for encoding a signal according to one embodiment of the present invention may include a downmixing unit 110, an object parameter extracting unit 120, and a control information generating unit 130. And, an apparatus 200 for decoding a signal according to one embodiment of the present invention may include a receiving unit 210, a control parameter generating unit 220, a rendering parameter generating unit 230, and a rendering unit 240.

The downmixing unit 110 of the signal encoding apparatus 100 downmixes plural object signals to generate an object downmix signal (hereinafter called downmix signal DX). In this case, the object signal is a channel signal or a source signal. In particular, the source signal can be a signal of a specific instrument.

The object parameter extracting unit 120 extracts an object parameter OP from plural the object signals. The object parameter includes object level information and inter-object correlation information. If the object signal is the channel signal, the object level information can include a channel level difference (CLD). If the object signal is the source signal, the object level information can include source level information.

The control information generating unit 130 generates at least one control information. In this case, the control information is the information provided to change a listener's virtual position or a virtual position of a multi-channel speaker or give a spatial characteristic to a source signal and may include HRTF filter information, object position information, object level information, etc. In particular, if the object signal is the channel signal, the control information includes listener's virtual position information, virtual position information for a multi-channel speaker. If the object signal is the source signal, the control information includes level information for the source signal, virtual position information for the source signal, and the like.

Meanwhile, in case that a listener's virtual position is changed, one control information is generated to correspond to a specific virtual position of a listener. In case that a spatial characteristic is given to a source signal, one control information is generated to correspond to a specific mode such as a live mode, a club band mode, a karaoke mode, a jazz mode, a rhythmic mode, etc. The control information is provided to adjust each source signal or at least one (grouped source signal) of plural source signals collectively. For instance, in case of the rhythmic mode, it is able to collectively adjust source signals associated with rhythmic instruments. In this case, 'to collectively adjust' means that several source signals are simultaneously adjusted instead of applying the same parameter to the respective source signals.

After having generated the control information, the control information generating unit 130 is able to generate a control information bitstream that contains a number of control informations (i.e., number of sound effects), a flag, and control information.

The receiving unit 210 of the signal decoding apparatus 200 includes a downmix receiving unit 211, an object parameter receiving unit 212, and a control information receiving unit 213. In this case, the downmix receiving unit 211, an object parameter receiving unit 212, and a control information receiving unit 213 receive a downmix signal DX, an object parameter OP, and control information CI, respectively. Meanwhile, the receiving unit 210 is able to further perform demuxing, parsing, decoding or the like on the received signals.

The object parameter receiving unit 212 extracts object information OI from the object parameter OP. If the object signal is a source signal, the object information includes a number of sources, a source type, a source index, and the like. If the object signal is a channel signal, the object information can include a tree configuration (e.g., 5-1-5 configuration) of the channel signal and the like. Subsequently, the object parameter receiving unit 212 inputs the extracted object information OI to the parameter generating unit 220.

The control parameter generating unit 220 generates a control parameter CP using at least one of the control information, the device information DI, and the object information OI. As mentioned in the foregoing description of the control information generating unit 130, the control information can includes HRTF filter information, object position information, object level information, and the like. If the object signal is a channel signal, the control information can include at least one of listener's virtual position information and virtual position information of a multi-channel speaker. If the control information is a source signal, the control information can include level information for the source signal and virtual position information for the source signal. Moreover, the control information can further include the concept of the device information DI.

Meanwhile, the control information can be classified into various types according to its provenance such as 1) control information (CI) generated by the control information generating unit 130, 2) user control information (UCI) inputted by a user, 3) device control information (not shown in the drawing) generated by the control parameter generating unit 220 of itself, and 4) default control information (DCI) stored in the signal decoding apparatus.

The control parameter generating unit 220 is able to generate a control parameter by selecting one of control information CI received for a specific downmix signal, user control information UCI, device control information, and default control information DCI. In this case, the selected control information may correspond to a) control information randomly selected by the control parameter generating unit 220 or b) control information selected by a user.

The device information DI is the information stored in the decoding apparatus 200 and includes a number of channels available for output and the like. And, the device information DI can pertain to a broad meaning of the control information.

The object information OI is the information about at least one object signal downmixed into a downmix signal and may correspond to the object information inputted by the object parameter receiving unit 212.

The rendering parameter generating unit 230 generates a rendering parameter RP by converting an object parameter OP using a control parameter CP. Meanwhile, the rendering parameter generating unit 230 is able to generate a rendering parameter RP for adding a stereophony to an output signal using correlation, which will be explained in detail later.

The rendering unit 240 generates an output signal by rendering a downmix signal DX using the rendering parameter RP. In this case, the downmix signal DX may be generated by the downmixing unit 110 of the signal encoding apparatus 100 and can be an arbitrary downmix signal that is arbitrarily downmixed by a user.

FIG. 2 is a block diagram of an apparatus for decoding a signal according to another embodiment of the present invention.

Referring to FIG. 2, an apparatus for decoding a signal according to another embodiment of the present invention is an example of extending the area-A of the signal decoding apparatus of the former embodiment of the present invention shown in FIG. 1 and further includes a rendering parameter encoding unit 232 and a rendering parameter decoding unit 234.

Besides, the rendering parameter decoding unit 234 and the rendering unit 240 can be implemented as a device separate from the signal decoding apparatus 200 including the rendering parameter encoding unit 232.

The rendering parameter encoding unit 232 generates a rendering parameter bitstream RPB by encoding a rendering parameter generated by a rendering parameter generating unit 230.

The rendering parameter decoding unit 234 decodes the rendering parameter bitstream RPB and then inputs a decoded rendering parameter to the rendering unit 240.

The rendering unit 240 outputs an output signal by rendering a downmix signal DX using the rendering parameter decoded by the rendering parameter decoding unit 234.

Each of the decoding apparatuses according to one and another embodiments of the present invention includes the above-explained elements. In the following description, details for the cases: 1) object signal is channel signal; and 2) object signal is source signal are explained.

1. Case of Channel Signal (Modification of Spatial Characteristic)

First of all, if an object signal is a channel signal, an object parameter can include channel level information and channel correlation information. By converting the channel level information (and channel correlation information) using a control parameter, it is able to generate the channel level information (and channel correlation information) converted to a rendering parameter.

Thus, the control parameter used for the generation of the rendering parameter may be the one generated using device information, control information, or device information & control information. A case of considering device information, a case of considering control information, and a case of considering both device information and control information are respectively explained as follows.

1-1. Case of Considering Device Information (Scalable)

If the control parameter generating unit 220 generates a control parameter using device information DI, and more particularly, a number of outputable channels, an output signal generated by the rendering unit 240 can be generated to have the same number of the outputable channels. By converting a channel level difference (and channel correlation) of an object parameter OP using the control parameter, the converted channel level difference can be generated. This is explained as follows. In particular, it is assumed that an outputable channel number is 2 and that an object parameter OP corresponds to the 5-1-$5_1$ tree configuration.

FIG. 3 is a block diagram to explain a relation between a channel level difference and a converted channel difference in case of the 5-1-$5_1$ tree configuration.

If a channel level difference and channel correlation meet the 5-1-$5_1$ tree configuration, the channel level differences CLD, as shown in a left part of FIG. 3, are $CLD_0$ to $CLD_4$ and the channel correlation ICC are $ICC_0$ to $ICC_4$ (not shown in the drawing). For instance, a level difference between a left channel L and a right channel R is $CLD_0$ and the corresponding channel correlation is $ICC_0$.

If the outputable channel number, as shown in a right part of FIG. 3, is 2 (i.e., left total channel Lt and right total channel Rt), a converted channel level difference CLD and a converted channel correlation ICC can be represented using the channel differences $CLD_0$ to $CLD_4$ and the channel correlations $ICC_0$ to $ICC_4$ (not shown in the drawing).

$$CLD_a=10*\log_{10}(P_{Lt}/P_{Rt}) \quad \text{[Formula 1]}$$

where, $P_{Lt}$ is a power of $L_t$ and $P_{Rt}$ is a power of $R_t$.

$$P_{Lt}=P_L+P_{Ls}+P_C/2+P_{LFE}/2 \quad \text{[Formula 2]}$$

$$P_{Rt}=P_R+P_{Rs}+P_C/2+P_{LFE}/2$$

$$\begin{bmatrix} P_L \\ P_R \\ P_C \\ P_{LFE} \\ P_{Ls} \\ P_{Rs} \end{bmatrix} = \begin{bmatrix} (c_{1,OTT3}c_{1,OTT1}c_{1,OTT0})^2 \\ (c_{2,OTT3}c_{1,OTT1}c_{1,OTT0})^2 \\ (c_{1,OTT4}c_{2,OTT1}c_{1,OTT0})^2 \\ (c_{2,OTT4}c_{2,OTT1}c_{1,OTT0})^2 \\ (c_{1,OTT2}c_{2,OTT0})^2 \\ (c_{2,OTT2}c_{2,OTT0})^2 \end{bmatrix} m^2 \quad \text{[Formula 3]}$$

$$c_{1,OTT_X}^{L,m} = \sqrt{\frac{10^{\frac{CLD_X^{L,m}}{10}}}{1+10^{\frac{CLD_X^{L,m}}{10}}}}$$

$$c_{2,OTT_X}^{L,m} = \sqrt{\frac{1}{1+10^{\frac{CLD_X^{L,m}}{10}}}}$$

$$P_C/2+P_{LFE}/2=(C_{2,OTT1}*C_{1,OTT0})^2*m^2/2 \quad \text{[Formula 4]}$$

By inserting Formula 4 and Formula 3 in Formula 2 and then inserting Formula 2 in Formula 1, it is able to represent the converted level difference CLD.

$$ICC_\alpha = \mathrm{Re}\left\{\frac{P_{LtRt}}{\sqrt{P_{Lt}P_{Rt}}}\right\}, \quad \text{[Formula 5]}$$

where $P_{x_1x_2}=\Sigma x_1x_2$ $$P_{LtRt}=P_{LR}+P_{LsRs}+P_C/2+P_{LFE}/2 \quad \text{[Formula 6]}$$

$$P_{LR}=ICC_3*c_{1,0TT3}*c_{2,0TT3}*(c_{1,0TT1}*c_{1,0TT0})^2*m^2 \quad \text{[Formula 7]}$$

$$P_{LsRs}=ICC_2*c_{1,0TT2}*c_{2,0TT2}*(c_{2,0TT0})^2*m^2$$

By inserting Formula 7 and Formula 3 in Formula 6 and then inserting Formula 6 and Formula 2 in Formula 5, it is able to represent the converted channel correlation $ICC_4$ using the channel differences $CLD_0$ to $CLD_4$ and the channel correlations $ICC_0$ to $ICC_4$.

1-2. Case of Considering Control Information

In case that the control parameter generating unit 220 generates a control parameter using control information, an output signal generated by the rendering unit 240 can provide various sound effects. For instance, in case of a popular music concert, sound effects for auditorium or sound effects on stage can be provided.

FIG. 4 is a diagram of a speaker arrangement according to ITU recommendations, and FIG. 5 and FIG. 6 are diagrams for virtual speaker positions according to 3-dimensional effects, respectively.

Referring to FIG. 4, according to ITU recommendations, speaker positions should be located at corresponding points for distances and angles for example and a listener should be at a central point.

If a listener, who is located at the point shown in FIG. 4, attempts to experience the same effect as located at a point shown in FIG. 5, gains of surround channels Ls and Rs including audience shouts are reduced, an angle is shifted in rear direction, and positions of left and right channels L and R are moved close to ears of the listener. In order to bring the same effect at the point shown in FIG. 6, an angle between the left channel L and the center channel C is reduced and gains of the left and center channels L and C are raised.

For this, after an inverse function of sound paths ($H_L$, $H_R$, $H_C$, $H_{Ls}$, $H_{Rs}$) corresponding to positions of speakers (L, R, Ls, Rs, C) to a listener has been passed, sound paths ($H_L$, $H_{R'}$, $H_{C'}$, $H_{Ls'}$, $H_{Rs'}$) corresponding to positions of virtual speakers (L', R', Ls', Rs', C') can be passed. In particular, a left channel signal can be represented by Formula 8.

$$L_{new}=\text{function}(H_L,H_{L'},L)=\text{function}(H_{L_tot},L) \quad \text{[Formula 8]}$$

If there exist several $H_L$, i.e., if various sound effects exist, Formula 8 can be expressed as Formula 9.

$$L_{new_i}=\text{function}(H_{L_tot_i},L) \quad \text{[Formula 9]}$$

In this case, control information corresponding to $H_{x_tot_I}$ is an arbitrary channel) can be generated by the control information generating unit 130 of the encoding apparatus or the control parameter generating unit 220.

Details of the principle for changing sound effects by converting an object parameter, and more particularly, a channel level difference CLD are explained as follows.

FIG. 7 is a diagram to explain a position of a virtual sound source between speakers. Generally, a arbitrary channel signal $x_i$ has a gain $g_i$ as shown in Formula 10.

$$x_i(k)=g_ix(k) \quad \text{[Formula 10]}$$

In this case, $x_i$ is an input signal of an $i^{th}$ channel, $g_i$ is a gain of the $i^{th}$ channel, and x is a source signal.

Referring to FIG. 7, if an angle between a virtual source VS and a tangential line is $\phi$, if an angle between two channels ch1 and ch2 is $2\phi_0$, and if gains of the channels ch1 and ch2 are g1 and g2, respectively, the following relation of Formula 11 is established.

$$\frac{\sin\varphi}{\sin\varphi_0} = \frac{g_1-g_2}{g_1+g_2} \quad \text{[Formula 11]}$$

According to Formula 11, by adjusting g1 and g2, it is able to vary the position q) of the virtual source VS. Since g1 and g2 are dependent on a channel level difference CLD, it is able to vary the position of the virtual source VS by adjusting the channel level difference.

1-3. Case of Considering Both Device Information and Control Information

First of all, the control parameter generating unit 240 is able to generate a control parameter by considering both device information and control information. If an outputable channel number of a decoder is 'M'. The control parameter generating unit 220 selects control information matching the outputable channel number M from inputted control informations CI, UCI and DCI, or the control parameter generating unit 220 is able to generate a control parameter matching the outputable channel number M by itself.

For instance, if a tree configuration of a downmix signal is 5-1-5 configuration and if an outputable channel number is 2, the control parameter generating unit 220 selects control information matching stereo channels from the inputted control informations CI, UCI and DCI, or the control parameter generating unit 220 is able to generate a control parameter matching the stereo channels by itself.

Thus, the control parameter can be generated by considering both of the device information and the control information.

2. Case of Source Signal

If an object signal is a source signal, an object parameter can include source level information. In case of rendering using the object parameter intact, an output signal becomes plural source signals that doe not have spatial characteristics.

In order to give a spatial characteristic to the object parameter, control information can be taken into consideration in generating a rendering parameter by converting the object parameter. Of course, like the case of a channel signal, it is able to consider device information (outputable channel number) as well as the control information.

Once the spatial characteristics are given to the respective source signals, each of the source signals can be reproduced to provide various effects. For instance, a vocal V, as shown in FIG. 8, is reproduced from a left side, a drum D is reproduced from a center, and a keyboard K is reproduced from a right side. For instance, vocal V and Drum D, as shown in FIG. 9, are reproduced from a center and a keyboard K is reproducible from a left side.

Thus, a method of using correlation IC to give specific stereophony to a source signal after the source signal has been placed at a specific position by giving a spatial characteristic is explained as follows.

2-1. Giving Stereophony Using Correlation IC

First of all, a human is able to perceive a direction of sound using a level difference between sounds entering a pair of ears (IID/ILD, interaural intensity/level difference) and a time delay of sounds heard through a pair of ears (ITD, interaural time difference). And, a 3-dimensional sense can be perceived by correlation between sounds heard through a pair of ears (IC, interaural cross-correlation).

Meanwhile, the correlation between sounds heard through a pair of ears (IC, interaural cross-correlation) can be defined as Formula 12.

$$IC_{x_1x_2} = \frac{E[x_1x_2^*]}{\sqrt{E[x_1x_1^*]E[x_2x_2^*]}} \quad \text{[Formula 12]}$$

In this case, $x_1$ and $x_2$ are channel signals and E[x] indicates energy of a channel-x.

Meanwhile, by adding stereophony to a channel signal, Formula 10 can be transformed into Formula 13.

$$x_{i,new}(k)=g_i(\alpha_i x(k)+s_i(k)) \quad \text{[Formula 13]}$$

In this case, $_i$ is a gain multiplied to an original signal component and $s_i$ is a stereophony added to an $i^{th}$ channel signal. Besides, $_i$ and $g_i$ are abbreviations of $_i(k)$ and $g_i(k)$, respectively.

The stereophony $s_i$ may be generated using a decorrelator. And, an all-pass filter can be used as the decorrelator. Although the stereophony is added, Amplitude Panning's Law should be met. So, $g_i$ is applicable to Formula 13 overall.

Meanwhile, $s_i$ is a value to adjust correlation IC. Although an independent value is usable for each channel, it can be represented as a product of a representative stereophony value and a per-channel gain.

$$s_i(k)=\beta_i s(k) \quad \text{[Formula 14]}$$

In this case, $_i$ is a gain of an $i_{th}$ channel and s(k) is a representative stereophony value.

Alternatively, it can be expressed as a combination of various stereophonies shown in Formula 15.

$$s_i(k)=\beta_i z_1(k)+\chi_i z_2(k)+\delta_i z_3(k)+\ldots \quad \text{[Formula 15]}$$

In this case, $z_n$ (k) is an arbitrary stereophony value. And, $\beta_i$, $x_i$, and $\delta_i$ are gains of an $i_{th}$ channel for the respective stereophonies.

Since a stereophony value s(k) or $z_n(k)$ (hereinafter called s(k)) is a signal having low correlation with a channel signal $x_i$, the correlation IC with the channel signal $x_i$ of the stereophony value s(k) may be almost close to zero. Namely, the stereophony value s(k) or $z_n(k)$ should consider x(k) or ($x_i$(k)). In particular, since the correlation between the channel signal and the stereophony is ideally zero, it can be represented as Formula 16.

$$C_{x_i s_i} = \frac{E[x_i s_i^*]}{E[\sum x_i x_i^* \sum s_i s_i^*]} = 0 \quad \text{[Formula 16]}$$

In this case, various signal processing schemes are usable in configuring the stereophony value s(k). The schemes include: 1) configuring the stereophony value s(k) with noise component; 2) adding noise to x(k) on a time axis; 3) adding noise to a amplitude component of x(k) on a frequency axis; 4) adding noise to a phase component of x(k); 5) using an echo component of x(k); and 6) using a proper combination of 1) to 5). Besides, in adding the noise, a quantity of the added noise is adjusted using signal size information or an unrecognized amplitude is added using a psychoacoustics model.

Meanwhile, the stereophony value s(k) should meet the following condition.

The condition says that a power of a channel signal should be kept intact even if a stereophony value is added to the channel signal. Namely, a power of $x_i$ should be equal to that of $x_{i_new}$.

To meet the above condition, $x_i$ and $x_{i_new}$, which are represented as Formula 10 and Formula 13, should meet Formula 17.

$$E[xx^*]=E[(\alpha_i x+s_i)(\alpha_i x+s_i)^*] \quad \text{[Formula 17]}$$

Yet, a right side of Formula 17 can be developed into Formula 18.

$$E[(\alpha_i x+s_i)(\alpha_i x+s_i)^*] = E\begin{bmatrix} \alpha_i\alpha_i^* xx^* + \alpha_i xs_i^* + \\ \alpha_i^* x^* s_i + s_i s_i^* \end{bmatrix} = E[\alpha_i\alpha_i^* x_i x_i^* + s_i s_i^*] \quad \text{[Formula 18]}$$

So, Formula 18 is inserted in Formula 17 to provide Formula 19.

$$E[xx^*]=\alpha_i^2 E[x_i x_i^*]+E[s_i s_i^*] \quad \text{[Formula 19]}$$

The condition can be met if formula 1 is met. So, $_i$ meeting Formula 19 is represented as Formula 20.

$$\alpha_i = \sqrt{1 - E\frac{[s_i s_i^*]}{E[xx^*]}} \quad \text{[Formula 20]}$$

In this case, assuming that $s_i$ is represented as Formula 14 and that a power of $s_i$ is equal to that of $x_i$, Formula 20 can be summarized into formula 21.

$$\alpha_i^2+\beta_i^2=1 \quad \text{[Formula 21]}$$

Since $\cos^2\theta_i+\sin^2\theta_i=1$, Formula 21 can be represented as Formula 22.

$$\alpha_i=\cos\theta_i, \beta_i=\sin\theta_i \quad \text{[Formula 22]}$$

So to speak, $s_i$ to meet the condition is the one that meets Formula 2, if $x_{i_new}$ is represented as Formula 13, if $s_i$ is represented as Formula 14, and if a power of $s_i$ is equal to that of $x_i$.

Meanwhile, correlation between $x_{1_new}$ and $x_{2_new}$ can be developed into Formula 23.

$$IC_{x_{1_new}x_{2_new}} = \frac{E[x_{1_new}x_{2_new}^*]}{\sqrt{E[x_{1_new}x_{1_new}^*]E[x_{2_new}x_{2_new}^*]}} = \frac{g_1 g_2^* E[\alpha_1\alpha_2^* xx^* + \beta_1\beta_2^* ss^*]}{\sqrt{g_1^2 E[\alpha_1^2 xx^* + \beta_1^2 ss^*] g_2^2 E[\alpha_2^2 xx^* + \beta_2^2 ss^*]}} = \frac{E[\alpha_1\alpha_2^* xx^* + \beta_1\beta_2^* ss^*]}{\sqrt{E[\alpha_1^2 xx^* + \beta_1^2 ss^*]E[\alpha_2^2 xx^* + \beta_2^2 ss^*]}} \quad \text{[Formula 23]}$$

Like the aforesaid assumption, assuming that a power of $s_i$ is equal to that of $x_i$, Formula 23 can be summarized into Formula 24.

[Formula 24]

$$IC_{x_{1_new}x_{2_new}} = \alpha_1\alpha_2^* + \beta_1\beta_2^* \quad \text{[Formula 24]}$$

And, Formula 24 can be represented as Formula 25 using Formula 21.

[Formula 25]

$$IC_{x_{1_new}x_{2_new}} = \cos\theta_1\cos\theta_2 + \sin\theta_1\sin\theta_2 = \cos(\theta_1 - \theta_2) \quad \text{[Formula 25]}$$

or $$\theta_1 - \theta_2 = \cos^{-1}(IC_{x1x2})$$

or $$\theta_1 - \theta_2 = \cos^{-1}(IC_{x_1x_2})$$

So to speak, it is able to find $x_{1_new}$ and $x_{2_new}$ using $\theta_1$ and $\theta_2$.

Hence, this method is able to enhance or reduce a 3-dimensional sense by adjusting a correlation IC value specifically in a manner of applying the same method to the case of having independent sources $x_1$ and $x_2$ as well as the case of using Amplitude Panning's Law within a single source x.

Industrial Applicability

Accordingly, the present invention is applicable to an audio reproduction by converting an audio signal in various ways to be suitable for user's necessity (listener's virtual position, virtual position of source) or user's environment (outputable channel number).

And, the present invention is usable for a contents provider to provide various play modes to a user according to characteristics of contents including games and the like.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

The invention claimed is:

1. A method of decoding a signal, comprising:

receiving, by an audio decoding apparatus, an object parameter corresponding to at least one object signal, the object parameter including at least one of object level information and inter-object correlation information;

generating a rendering parameter corresponding to an output channel by applying a control parameter to the object parameter;

generating the output channel by applying the rendering parameter to an object downmix signal resulting from downmixing the object signal;

wherein the control parameter is generated using control information comprising at least one of user control information, default control information, device control information, and device information; and wherein the one object signal comprises a channel signal or a source signal.

2. The method of claim 1, wherein if the object signal is a channel signal, the object level information includes a channel level difference.

3. The method of claim 1, wherein if the object signal is a source signal, the object level information includes a source level difference.

4. The method of claim 1, wherein if the object signal is a source signal, the user control information comprises at least one of level information of the source signal and virtual position information of the source signal.

5. The method of claim 1, further comprising:

generating a rendering parameter bitstream by encoding the rendering parameter; and, obtaining the rendering parameter by decoding the rendering parameter bitstream.

6. An apparatus for decoding a signal, comprising:

a hardware decoding device for:

receiving an object parameter corresponding to at least one object signal, the object parameter including at least one of object level information and inter-object correlation information;

generating a rendering parameter corresponding to an output channel by applying a control parameter to the object parameter;

generating the output channel by applying a rendering parameter to an object downmix signal resulting from downmixing the object signal;

wherein the control parameter is generated using control information comprising at least one of user control information, default control information, device control information, and device information; and wherein the one object signal comprises a channel signal or a source signal.

7. The apparatus of claim 6, further comprising:

a rendering parameter encoding unit generating a rendering parameter bitstream by encoding the rendering parameter; and a rendering parameter decoding unit obtaining the rendering parameter by decoding the rendering parameter bitstream.

* * * * *